United States Patent [19]

Curtis et al.

[11] Patent Number: 4,905,578

[45] Date of Patent: Mar. 6, 1990

[54] APPARATUS FOR VENTILATING CONTROLLED AREAS

[76] Inventors: Michael S. Curtis, P.O. Box 218, Glorieta, N. Mex. 87535; Robert W. Weeks, Jr., P.O. Box 340, Los Alamos, N. Mex. 87544

[21] Appl. No.: 293,097

[22] Filed: Jan. 3, 1989

[51] Int. Cl.[4] ..... F24F 7/08

[52] U.S. Cl. ..... 98/1.5; 98/115.4

[58] Field of Search ..... 98/1.5, 33.1, 34.5, 98/34.6, 38.9, 115.1, 115.4, DIG. 7

[56] References Cited

U.S. PATENT DOCUMENTS

| | | | |
|---|---|---|---|
| 1,858,024 | 5/1932 | Moore | 98/34.5 |
| 2,898,836 | 8/1959 | Lockheed | 98/1.5 |
| 3,107,974 | 10/1963 | Potapenko | 98/1.5 X |
| 3,211,075 | 10/1965 | Robson | 98/1.5 |
| 3,402,654 | 9/1968 | Berst | 98/1.5 |
| 4,485,729 | 12/1984 | Crittenden et al. | 98/1.5 |
| 4,604,111 | 8/1986 | Natale | 98/33.1 X |
| 4,817,864 | 4/1989 | Payne | 98/1.5 X |

FOREIGN PATENT DOCUMENTS

| | | | |
|---|---|---|---|
| 54-68035 | 5/1979 | Japan | 98/1.5 |
| 57-136041 | 8/1982 | Japan | 98/1.5 |

*Primary Examiner*—Harold Joyce

*Attorney, Agent, or Firm*—Samuel M. Freund

[57] ABSTRACT

The apparatus includes a device adapted for removing contaminated air from a controlled area, cleansing this air using suitable filtration devices, and returning air having a safe level of contaminants mixed with a portion of fresh air or solely fresh air to the controlled area. The apparatus further includes barrier means for preventing contaminants from exiting the controlled area except through the air removal device which can be located either inside or outside of the controlled area.

22 Claims, 4 Drawing Sheets

APPARATUS FOR VENTILATING CONTROLLED AREAS

BACKGROUND OF THE INVENTION

The present invention relates generally to apparatus and methods for controlling hazardous dusts, mists, fumes, aerosols, and vapors, and more particularly to the use of a controlled pressure ventilation system to confine the work area while maintaining a flow of fresh air into the area.

The difficulty with controlling hazardous (including toxic) airborne dusts, mists, fumes, aerosols, and vapors is well-documented. This difficulty is further compounded when such materials must be controlled on an emergency basis as the result of a spill or a situation where uncontrolled dissemination of aerosolized contaminants would endanger lives or health. The removal of contaminated area air prevents the buildup of concentrations thereof in the work area. The neutral or positive pressure replacement of filtered air prevents the creation of uncontrolled negative pressures within the work area which may be destructive to the containment barriers, reduces the tendency of particles to become dislodged from their place of location, and provides a more comfortable environment for "clean-up" crews. Moreover, a neutral or positive pressure in the work area prevents the entrance of ambient contaminants which may interfere with the monitoring of the containment area.

In "Particulate Contamination Control Method And Filtration Device," U.S. Pat. No. 4,604,111 issued to Anthony Natale on Aug. 5, 1986, the inventor describes a negative pressure method and apparatus for protection from airborne asbestos and other particulate contamination including an enclosure with doorways and decontamination chambers having air intake therethrough with at least one filtration unit flow connected to the enclosure with a blower to pull air into the filtration unit and dispel the filtered air into the atmosphere. A high volume air flow intake is maintained resulting in a significant negative air pressure in the enclosure. Filtration devices are provided with multiple entrance ports to receive the discharge from separate vacuum cleaners as well as generating a large volume of air flow in the enclosure.

In "Differential Pressure Containment System" promotional literature distributed by The Brand Companies, 1420 Renaissance Drive, Park Ridge, Ill. 60068, the authors state that "While the 'negative air' system remains useful, we have growing concerns for any approach which indiscriminately advocates the removal of large quantities of anything, including air, from that contaminated work area." They advocate the use of an air filtering device to exhaust the air in the region of contamination and so restrict the air entering the workplace that the pressure is reduced by a readable amount (to between 0.02 and 0.04 inches of water). It is stated that this pressure is above that at which plastic begins to float free from the floor and fall from the walls. Minimal amounts of air are released to the outside. As stated hereinabove, such a limitation in the flow of air into the contaminated region may produce uncomfortable working conditions for the individuals tasked with removing the source of contamination.

Accordingly, it is an object of the present invention to provide means for localizing a source of contamination while generating a significant flow of clean air into the region of contamination.

Another object of the present invention is to provide means for localizing a source of contamination while maintaining a desired pressure differential in the region thereof.

It is a further object of our invention to provide means for localizing a source of contamination while substantially preventing contaminant particles from being dislodged from their sites of location and entering the region of contamination.

Yet another object of our invention is to provide means for localizing a source of contamination while substantially preventing ambient materials from interfering with the measurement of the degree of contamination in the region thereof.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, the apparatus hereof includes a controlled pressure ventilation generating device located outside of the area in which contamination is to be controlled for removal and filtration of containment area air and replacement thereof with a mixture including filtered ambient air from inside of the containment area and air from outside of the containment area.

It is preferred that the controlled pressure ventilation device cooperate with pressure sensors within the region of contamination so that a chosen pressure is capable of being maintained.

It is also preferred that barrier material (polyethylene, vinyl, etc.) be utilized for lining the floors, walls and/or ceiling areas of the region of contamination for increasing the containment capability of the structure surrounding the area in which containment is to be controlled.

Preferably, the barrier material has a sticky backing for adhering to the structure and creating a barrier impermeable to the type of contaminant intended to be controlled.

It is also preferred that a chambered personnel entry system be employed, each chamber being atmospherically isolated from the others by self-sealing doors, each chamber further having controlled, chosen pressure ventilation and filtration to prevent contamination transfer from one chamber to the next and to provide a continuously clean, safe atmosphere for the movement of personnel into and out of the containment area.

Benefits and advantages of the present invention include the provision of fresh air to workers in a containment region, the substantial prevention of contaminant materials from being dislodged from their location, the ease of placement of barrier materials into a contaminated area, the elimination of the necessity of cleaning and decontaminating of the ventilation device or devices, and the prevention of materials outside the contamination region from interfering with the measurement of the level of contamination therein.

BRIEF DESCRIPTION OF THE DRAWINGS

The accompanying drawings, which are incorporated in and form a part of the specification, illustrate three embodiments of the present invention and, together with the description, serve to explain the principles of the invention. In the drawings.

DETAILED DESCRIPTION OF THE PREFERRED EMBODIMENTS OF THE INVENTION

Briefly, the apparatus of the present invention includes a device adapted for removing contaminated air from a controlled area, cleansing this air using suitable filtration devices, and returning air having a safe level of contaminants mixed with a portion of fresh air or solely fresh air to the controlled area. The apparatus of our invention further includes barrier means for preventing contaminants from exiting the controlled area except through the air removal device which can be located either inside or outside of the controlled area. Chosen, controlled pressure relative to regions outside of the controlled area is maintained within the controlled area to assist in the maintenance of the integrity of the barrier means.

Figure 1:
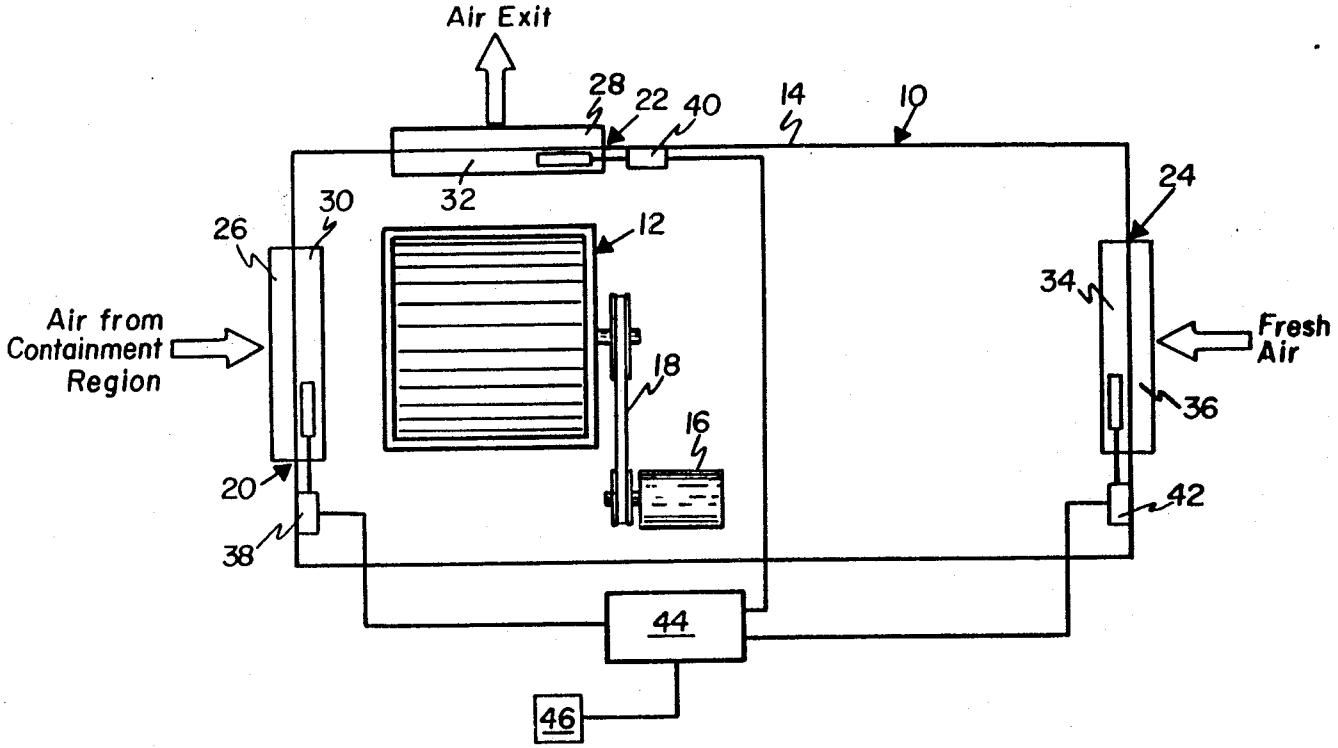
FIG. 1 is a schematic representation of one embodiment of the controlled pressure generating device employed in our invention. Shown is a three port apparatus for removing contaminated air from a work area, for returning air with contaminants reduced to a safe level to the work area, and for adding some portion of fresh air to the work area. This embodiment requires that the work area have a filtered vent.

Reference will now be made in detail to the present preferred embodiments of the invention, an example of which is illustrated in the accompanying drawings. Turning now to FIG. 1 hereof, FIG. 1 is a schematic representation of one embodiment of the neutral or positive pressure generating device employed in our invention. Shown is a three port apparatus 10 for removing contaminated air from a work area, for returning air with contaminants reduced to a safe level to the work area, and for adding some portion of fresh air to the work area. Blower means 12, located in enclosure 14, is driven by motor 16 through belt 18, removes air from a region of pollutant containment, by establishing a low pressure region in enclosure 14 relative to the region of pollutant containment. Air enters the enclosure through entrance port 20 and is directed out of the enclosure through exit port 22. Fresh air may be added to the exit air permitting fresh air to enter enclosure 14 through entrance port 24. Each of ports 20 and 22 has a filter 26, and 28, respectively to remove chemical and particulate pollutants. Each of ports 20, 22, and 24 has flow damper means, 30, 32, and 34 respectively, to control the relative pressure inside of enclosure 14 and that of the region of pollutant containment. The throughput of blower means 12 can also be adjusted to achieve this end. Entrance port 24 may also be fitted with a filter 36 to ensure the purity of any makeup air admitted to the system which includes the pollutant containment region, enclosure 14, and any required ducting. This embodiment requires that the work area have a filtered vent, since if fresh air is added to the system, air will have to be leave in order for air flow to be maintained. The unavoidable air leakage deriving from attempts to contain any volume of pollutants may often be sufficient to permit makeup air to be added to the system without the necessity of employing a filtered vent. Fresh makeup air is often necessary to improve the working conditions for the cleanup crew. It would be apparent to a person having ordinary skill in the art of apparatus for moving air, after studying the present disclosure, that other air moving devices, such as fans, and the like might be used instead of the blower described herein. Flow damper means 30, 32, and 34 are actuated by transducers 38, 40, and 42, respectively, which are driven by sensor/driver means 44 which responds to the pressure in the pollution containment region sensed by pressure sensor 46. A chosen, controlled pressure in the containment region may thereby be maintained.

Figure 2:
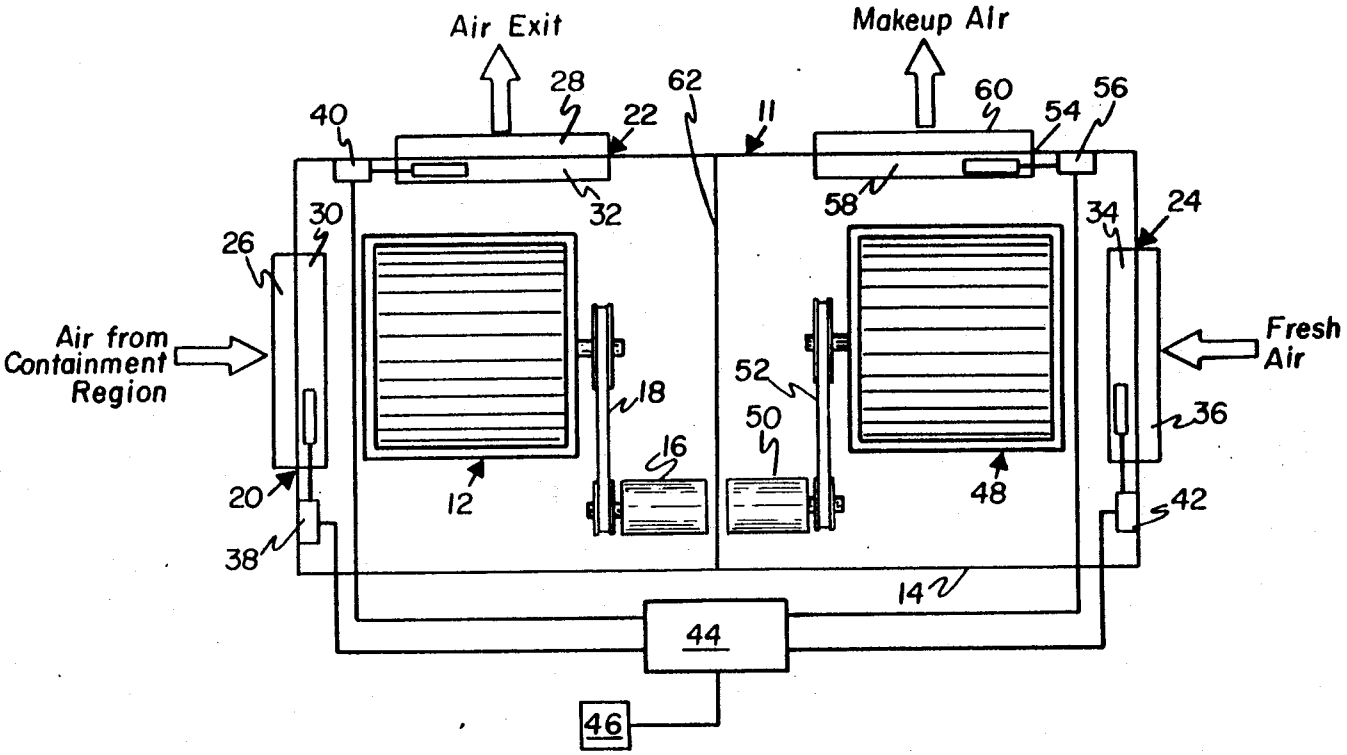
FIG. 2 is a schematic representation of a second embodiment of the controlled pressure generating device of the present invention. Shown is a four port, two fan apparatus wherein fresh air is added to at least make up the volume of the removed contaminated air which is filtered and discharged outside the work area.

FIG. 2 is a schematic representation of a second embodiment of the controlled pressure generating device of the present invention. Shown is a four port, two fan apparatus 11 wherein fresh air is added to at least make up the volume of the removed contaminated air which is filtered and discharged outside the work area. The numbers employed in this Figure are the same as those of FIG. 1 hereof when used to identify identical or similar structure. Second blower means 48 driven by motor 50 through belt 52 is used to direct fresh air taken from outside of the pollutant containment area into the containment area through exit port 54. Air exiting exit port 22 is released outside of the containment area, in contrast to the operation of the embodiment of our invention shown in FIG. 1 hereof. Transducer 56 operates flow control damper 58 under control from sensor/driver means 44. Filter 60 is provided in the event that "fresh" air drawn into enclosure 14 is taken from regions outside of the containment region which may be suspicious in their air purity. Partition 62 provides isolation between the air withdrawal and air supply portions of apparatus 11 in the event that complete separation between these portions is required, due perhaps to the extremely hazardous nature of the pollutants involved. Filters 26, 28, 36, and 60 may include HEPA filters and are adapted to the nature of the gases or particulates to be removed. Filters 26 and 36 prevent significant contamination of apparatus 10 and 11.

Figure 3:
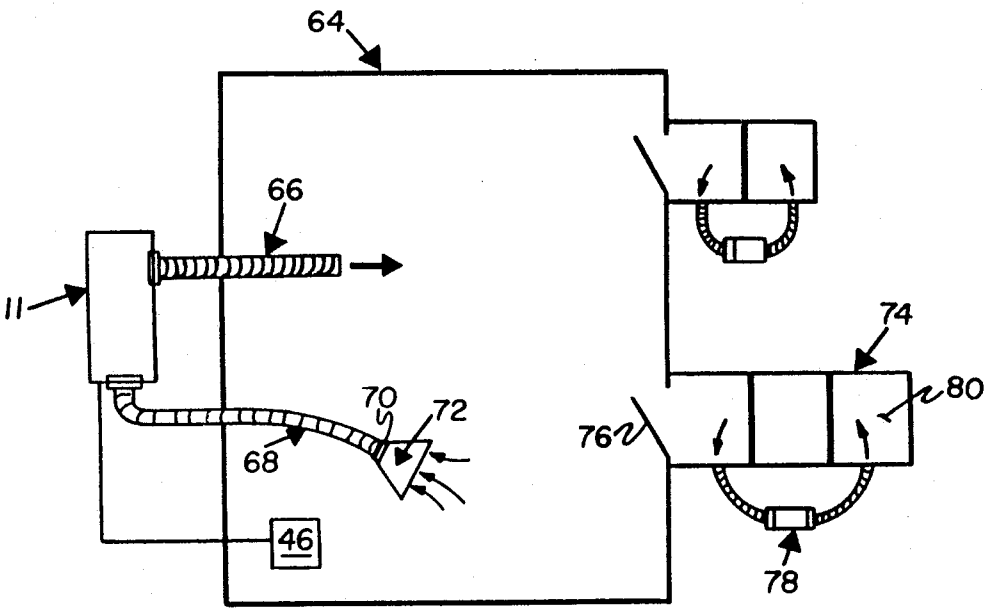
FIG. 3 is a schematic representation of the application of the apparatus of the present invention for defining and containing a contaminated area and for supplying air having a safe level of contaminants thereto.

FIG. 3 is a schematic representation of the application of the apparatus of the present invention for defining and containing a contaminated area and for supplying air having a safe level of contaminants thereto. Fresh air is shown being supplied by apparatus 11 to pollution containment region 64 through flexible duct means 66, while contaminated air is being withdrawn through flexible duct means 68. Pressure sensor 46 is also shown in the region of containment. Additional filter means 70 may be employed to assist in the reduction in contaminant level at the entrance to apparatus 11. Vent hood 72 may be placed over the region being worked on by personnel to immediately remove the contaminants rendered airborne in the process of contaminant removal. Personnel entry port means 74 is provided for personnel entry and egress from pollutant containment region 64. A slightly positive pressure is maintained in entry port means 74 so that when door 76 is operated, a minimum of pollutant escape occurs. Filtered blower means 78 maintains a yet slightly higher pressure in outermost chamber 80.

Figure 4:
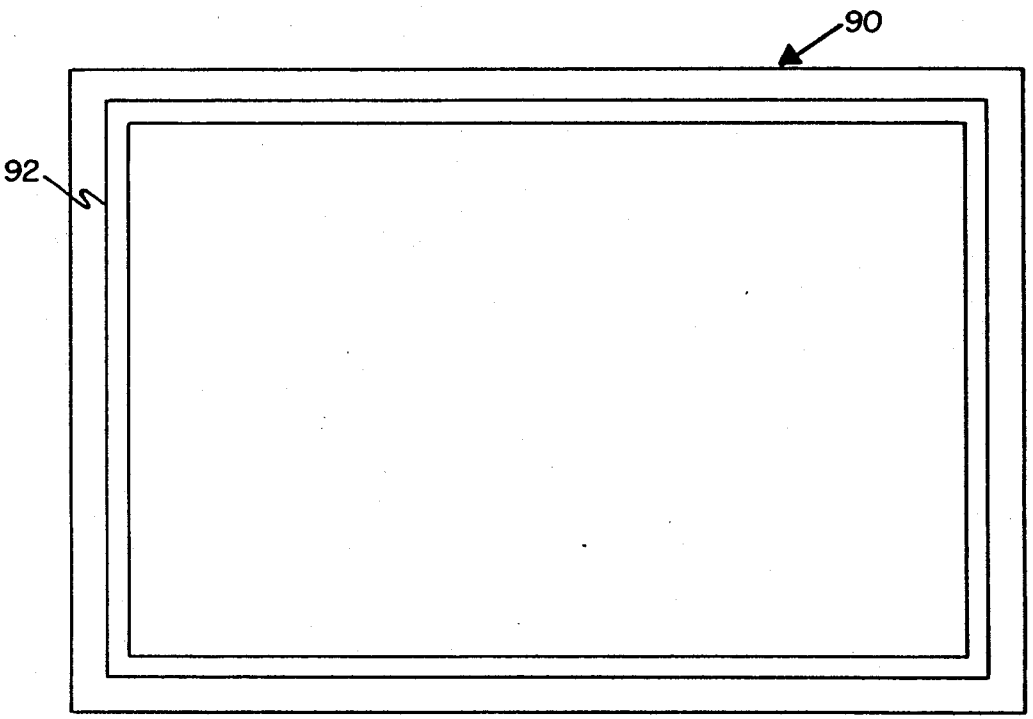
FIG. 4 is a schematic representation of the adhesive-backed barrier material employed in containing contaminants to a defined work area.

FIG. 4 is a schematic representation of the adhesive-backed barrier material employed in containing contaminants to a defined work area. Barrier material 90 is backed with adhesive material 92 in any of a variety of patterns, one of which is shown in FIG. 4, thereby facilitating installation thereof on wall or on ceiling surfaces.

The foregoing description of several preferred embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What we claim is:

1. A controlled area ventilation apparatus comprising in combination:

a substantially airtight enclosure having at least one first entrance port for permitting air to pass from inside of the controlled area into said enclosure, at least one second entrance port for permitting air from outside of the controlled area to pass into said enclosure, and at least one first exit port for permitting air to pass from inside of said enclosure into the controlled area;

air circulating means inside of said enclosure having the output thereof directed towards said at least one first exit port;

first air flow control means covering said at least one first entrance port for controlling the flow of air therethrough;

second air flow control means covering said at least one second entrance port for controlling the flow of air therethrough; and third air flow control means covering said at least one first exit port for controlling the flow of air therethrough, whereby a chosen differential pressure can be established inside of the controlled area.

2. The controlled area ventilation apparatus as described in claim 1, further comprising pressure sensing means located inside of the controlled area and having an output which is related to the pressure inside of the controlled area, and air balancing means for receiving the output from said pressure sensing means and for controlling the relative flows of air through said at least one first air flow control means, said at least one second air flow control means, and said at least one third air flow control means.

3. The controlled area ventilation apparatus as described in claim 2, further comprising first filter means for filtering the air entering said enclosure through said at least one first entrance port.

4. A controlled area ventilation apparatus comprising in combination:

a substantially airtight enclosure having, at least one first entrance port for permitting air to pass from inside of the controlled area into said enclosure, at least one second entrance port for permitting air from outside of the controlled area to pass into said enclosure, at least one first exit port for permitting air to pass from inside of said enclosure to a location outside of he controlled area, and at least one second exit port for permitting air to pass from inside of said enclosure into the controlled area;

first air circulating means inside of said enclosure having the output thereof directed towards said at least one first exit port;

second air circulating means inside of said enclosure having the output thereof directed towards said at least one second exit port;

first air flow control means covering said at least one first entrance port for controlling the flow of air therethrough;

second air flow control means covering said at least one second entrance port for controlling the flow of air therethrough;

third air flow control means covering said at least one first exit port for controlling the flow of air therethrough; and fourth air flow control means covering said at least one second exit port for controlling the flow of air therethrough, whereby a chosen differential pressure can be established inside of the controlled area.

5. The controlled area ventilation apparatus as described in claim 4, further comprising pressure sensing means located inside of the controlled area and having an output related to the pressure inside of the controlled area, and air balancing means for receiving the output from said pressure sensing means and for controlling the relative flow of air through said at least one first air flow control means, said at least one second air flow control means, said at least one third air flow control means, and said at least one fourth air flow control means.

6. The controlled area ventilation apparatus as described in claim 5, further comprising first filter means for filtering the air entering said enclosure through said at least one first entrance port.

7. The controlled area ventilation apparatus as described in claim 5, further comprising air isolation means for providing substantial air isolation between said first air circulating means, said at least one first entrance port, and said at least one first exit port, and said second air circulating means, said at least one second entrance port, and said at least one second exit port.

8. The controlled area ventilation apparatus as described in claim 6, further comprising second filtering means for filtering the air leaving said enclosure through said at least one first exit port.

9. The controlled area ventilation apparatus as described in claim 3, 6 or 7, further comprising first flexible duct means for permitting the air intake for said at least one first entrance port to be located in the proximity of a region of work inside of the controlled area, and second flexible duct means for permitting the air transmitted through said at least one second exit port to be transported to the proximity of the region of work inside of the controlled area.

10. The controlled area ventilation apparatus as described in claim 9, further comprising third filtering means for filtering the air entering said first flexible duct means.

11. The controlled area ventilation apparatus as described in claim 10, further comprising barrier material for covering at least a portion of the exposed surfaces of the controlled area in order to prevent substantial leakage of contaminant material out of the controlled area except that which flows through said enclosure in said controlled area ventilation apparatus.

12. The controlled area ventilation apparatus as described in claim 11, wherein said barrier material is backed with an adhesive material to aid in installation thereof.

13. The controlled area ventilation apparatus as described in claim 12, further comprising a personnel entry apparatus having at least one chamber for permitting entry into the controlled area without substantially breaking the air isolation thereof from its surroundings.

14. The controlled area ventilation apparatus as described in claim 13, wherein said at least one chamber has self-sealing doors for entry and exit to the surrounding area and for entry and exit to the controlled area.

15. The controlled area ventilation apparatus as described in claim 14, further comprising positive ventilation means for preventing air from the controlled area from entering said at least one chamber when said self-sealing doors are operated.

16. The controlled area ventilation apparatus as described in claim 15, further comprising filtering means for filtering air exiting said at least one chamber in order to remove substantially all contaminant materials present therein.

17. The controlled area ventilation apparatus as described in claim 3, 6, or 7 further comprising barrier material for covering at least a portion of the exposed surfaces of the controlled area in order to prevent substantial leakage of contaminant material out of the controlled area except that which flows through said enclosure in said controlled area ventilation apparatus.

18. The controlled area ventilation apparatus as described in claim 17, wherein said barrier material is backed with an adhesive material to aid in installation thereof.

19. The controlled area ventilation apparatus as described in claim 18, further comprising a personnel entry apparatus having at least one chamber for permitting entry into the controlled area without substantially breaking the air isolation thereof from its surroundings.

20. The controlled area ventilation apparatus as described in claim 19, wherein said at least one chamber has self-sealing doors for entry an exit to the surrounding area and for entry and exit to the controlled area.

21. The controlled area ventilation apparatus as described in claim 20, further comprising positive ventilation means for preventing air from the controlled area from entering said at least one chamber when said self-sealing doors are operated.

22. The controlled area ventilation apparatus as described in claim 21, further comprising filtering means for filtering air exiting said at least one chamber in order to remove substantially all contaminant materials present therein.

* * * * *